US009662923B2

(12) United States Patent
Takeishi

(10) Patent No.: US 9,662,923 B2
(45) Date of Patent: May 30, 2017

(54) IMAGE FORMING APPARATUS AND METHOD FOR PROCESSING REUSED SHEET

(71) Applicants: KABUSHIKI KAISHA TOSHIBA, Tokyo (JP); TOSHIBA TEC KABUSHIKI KAISHA, Tokyo (JP)

(72) Inventor: Toshiki Takeishi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/220,475

(22) Filed: Jul. 27, 2016

(65) Prior Publication Data

US 2017/0008328 A1 Jan. 12, 2017

Related U.S. Application Data

(62) Division of application No. 14/796,952, filed on Jul. 10, 2015, now Pat. No. 9,527,329.

(51) Int. Cl.

| | |
|---|---|
| ***B41M 7/00*** | (2006.01) |
| ***G03G 15/20*** | (2006.01) |
| ***G03G 15/00*** | (2006.01) |

(52) U.S. Cl.
CPC ..... *B41M 7/0009* (2013.01); *B41M 7/009* (2013.01); *G03G 15/2003* (2013.01); *G03G 15/5062* (2013.01); *G03G 15/6582* (2013.01)

(58) Field of Classification Search
CPC . B41M 7/0009; B41M 7/009; G03G 15/2003; G03G 15/5062; G03G 15/6582
See application file for complete search history.

(56) References Cited

U.S. PATENT DOCUMENTS

2011/0317198 A1* 12/2011 Suzuki ..... B41M 7/0009 358/1.13
2015/0124270 A1 5/2015 Megawa

* cited by examiner

*Primary Examiner* — Bradley Thies
(74) *Attorney, Agent, or Firm* — Patterson & Sheridan, LLP

(57) ABSTRACT

A sheet erasing apparatus according to an embodiment includes an erasing unit, a scanning unit, and first, second and third sheet cassettes. A processing unit determines a number of times of reuse, and whether the sheet is reusable. When the sheet is determined to be reusable and the number of times reuse is less than a predetermined number, the sheet is conveyed to the first sheet cassette. When the sheet is determined to be reusable and the number of times of reuse is equal to a predetermined number, the sheet is conveyed to the second sheet cassette. When the sheet is determined to not be reusable, the sheet is conveyed to the third sheet cassette.

2 Claims, 11 Drawing Sheets

IMAGE FORMING APPARATUS AND METHOD FOR PROCESSING REUSED SHEET

CROSS-REFERENCE TO RELATED APPLICATION

This application is a division of co-pending U.S. patent application Ser. No. 14/796,952, filed on Jul. 10, 2015, the entire contents of each of which are incorporated herein by reference.

FIELD

Embodiments described herein relate generally to an image forming apparatus that reuses a sheet on which an image is formed with a decolorable colorant and a method for processing a reused sheet.

BACKGROUND

In the related art, image forming apparatuses such as a multifunction peripheral (MFP) are used to form images on a sheet. In order to reuse a sheet, it is possible to form images with a decolorable colorant on a sheet. When a decolorable colorant is used in forming images, the sheet may be reused by erasing images later with an erasing apparatus.

The decolorable colorant is erased by applying high temperature heat thereto. Therefore, the erasing apparatus is used to heat the sheet and erase images formed on the sheet when reusing the sheet. The erasing apparatus heats the sheet by transporting the sheet through a press roller and a heat source. In this manner, the decolorable colorant is erased. Reusing sheets leads to saving sheets and may contribute to environmental protection. Erasing images formed on the sheet may be called "decolorization" in the description below.

Erasing apparatuses in the related art determine whether a sheet is reusable after erasing images printed with a decolorable colorant. Determination of whether a sheet is reusable depends on the presence or absence of a residue of an erased image and/or the state (deformation, damage, stains, and the like) of a sheet. For example, when images are formed, and post-processing such as punching and stapling is performed by a finisher, the sheet may be determined as nonreusable because of the damage. For this reason, post-processing such as punching and stapling is avoided.

In addition, in the erasing apparatus, there may be a limit on the number of times of reuse. For example, a sheet that is reused for N times (where N is the maximum allowable number of reuse) may be transported to a reject cassette as a nonreusable sheet.

DETAILED DESCRIPTION

A sheet erasing apparatus according to an embodiment includes an erasing unit, a scanning unit, and first, second and third sheet cassettes. A processing unit determines a number of times of reuse, and whether the sheet is reusable. When the sheet is determined to be reusable and the number of times reuse is less than a predetermined number, the sheet is conveyed to the first sheet cassette. When the sheet is determined to be reusable and the number of times of reuse is equal to a predetermined number, the sheet is conveyed to the second sheet cassette. When the sheet is determined to not be reusable, the sheet is conveyed to the third sheet cassette.

Hereinafter, exemplary embodiments will be described with reference to the appended drawings. The same places in each drawing will be given the same sign.

First Embodiment

Figure 1:
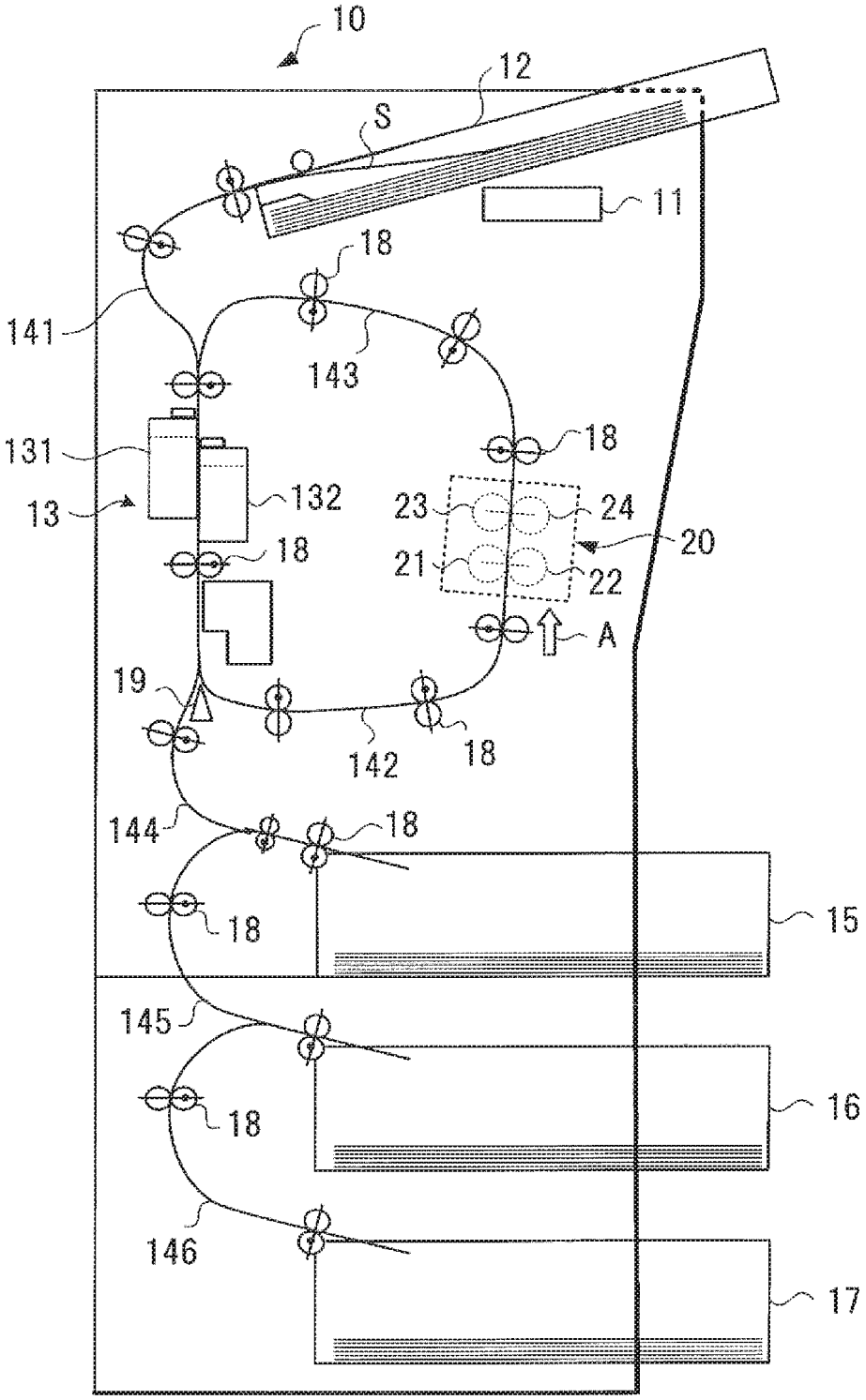
FIG. 1 illustrates an example configuration of an erasing apparatus.

FIG. 1 illustrates an example configuration of an erasing apparatus 10. The erasing apparatus 10 is capable of making a sheet reusable by erasing an image that is formed with a decolorable colorant on the sheet. The sheet from which an image is erased is then used by a later-described image forming apparatus.

An erasing apparatus 10 is provided with an operating unit 11 that includes an operating panel and a display, a sheet feeding unit 12, and a scanner 13. In addition, the erasing apparatus 10 includes a first to a sixth transport path 141 to 146 and a plurality of sheet discharge cassettes 15, 16, and 17.

Each of the transport paths 141 to 146 includes a plurality of transport rollers 18 for transporting a sheet. Each of the plurality of transport rollers 18 is driven by a motor. A gate 19 is positioned to divide the sheet transport path 141 into the transport path 142 and the transport path 144. An erasing unit 20 is disposed on the transport path 142.

The first transport path 141 transports a sheet S from the sheet feeding unit 12 to the scanner 13. The second transport path 142 transports the sheet S from the scanner 13 toward the erasing unit 20 in a direction of an arrow A. The third transport path 143 transports the sheet S from the erasing unit 20 to the scanner 13 again. The fourth transport path 144 transports the sheet S to the sheet discharge cassette 15. The fifth transport path 145 transports the sheet S to the sheet discharge cassette 16. The sixth transport path 146 transports the sheet S to the sheet discharge cassette 17.

The sheet discharge cassette 15 is a reuse cassette that retains a reusable sheet after an image is erased therefrom. The sheet discharge cassette 16 is a reject cassette that retains a sheet which is not reusable and is to be recycled (nonreusable sheet). The sheet discharge cassette 17 is a last reuse cassette that retains a sheet of which the number of times of reuse will soon reach an allowable number of times (N times).

Assuming that the allowable number of reuse is N, the sheet discharge cassette 17 retains a sheet (regular sheet) of which the number of reuse has reached N−1. That is to say, the sheet discharge cassette 17 retains a sheet that can be reused one last time in the next printing (image forming). The sheet discharge cassette 17 serves as a dedicated cassette for a sheet of which the number of reuse reaches N−1. Since a sheet that is transported to the sheet discharge cassette 17 will not be reused after an image is formed thereon by the image forming apparatus, post-processing such as punching and stapling may be performed for the sheet.

In the description below, the sheet discharge cassette 15, the sheet discharge cassette 16, and the sheet discharge cassette 17 are respectively called a reuse cassette 15, a reject cassette 16, and a last reuse cassette 17.

The erasing apparatus 10 in FIG. 1 generally performs an erasing process as follows. First, a mode of decolorization and reading for the sheet S is selected in the operating unit 11. Afterward, the sheet S is transported from the sheet feeding unit 12 to the scanner 13 through the transport path 141. The scanner 13 includes a first scanner 131 and a second scanner 132 and scans both sides of the sheet S. The scanner 13 scans an image of each side of the sheet and generates corresponding image data before the image on the sheet S is decolorized. In addition, the scanner 13 reads a mark (will be described later) that is printed on the sheet. The mark is printed by the image forming apparatus as will be described later.

The scanner 13 further reads the percentage of printing and the printing status on the sheet S. The state of the sheet S is determined from the read printing status. The sheet S is determined to be nonreusable when the state includes deformation such as ripples and crumples or damage such as punched holes on the sheet S. The sheet S that is determined as nonreusable is transported to the reject cassette 16 through the fifth transport path 145. A sheet having a high percentage of printing is also determined to be nonreusable, because the sheet is likely to curl at the time of decolorization, and thus is transported to the reject cassette 16. The sheet S having no ripples or crumples, or a sufficiently low percentage of printing is transported to the erasing unit 20 by the second transport path 142.

The erasing unit 20 includes a first erasing unit and a second erasing unit. The first erasing unit includes a heating roller 21 and a press roller 22. The second erasing unit includes a press roller 23 and a heating roller 24. The sheet S is heated by being transported through the heating roller 21 and the press roller 22 and through the press roller 23 and the heating roller 24. The heating rollers 21 and 24 are provided with heat sources therein. A lamp, for example, may be used as a heat source.

The sheet S that is transported to the erasing unit 20 is heated when passing through the erasing unit 20, and the image formed on the sheet S is decolorized by heat. The erasing unit 20 applies heat and pressure to the sheet S at a comparatively high temperature of, for example, 175° C. to 200° C. and decolorizes the image on the sheet S. That is to say, a decolorable colorant is used in forming the image on the sheet S, and the decolorable colorant is decolorized when reaching a predetermined temperature. Therefore, the image on the sheet S may be decolorized by transporting the sheet S to the erasing unit 20 that heats the sheet S at the predetermined temperature.

The sheet S that passes through the erasing unit 20 is again transported to the scanner 13 by the third transport path 143. The scanner 13 reads again the printing status, as previously described. It is then determined whether the image is completely decolorized. The sheet S that is determined as reusable from the result of reading by the scanner 13 after the image is erased is transported as a reuse sheet to the reuse cassette 15 through the fourth transport path 144.

Based on the printing status that is read by the scanner 13, the sheet S determined to have an image formed with a non-decolorable colorant or a handwritten image that remains in an image area is transported to the reject cassette 16 through the fifth transport path 145. The sheet S that is determined to be rippled or crumpled is also transported to the reject cassette 16. The scanner 13 further reads the mark that is printed on the sheet S and determines the number of reuse. A sheet having the number of reuse of N−1 is retained in the last reuse cassette 17.

Figure 2:
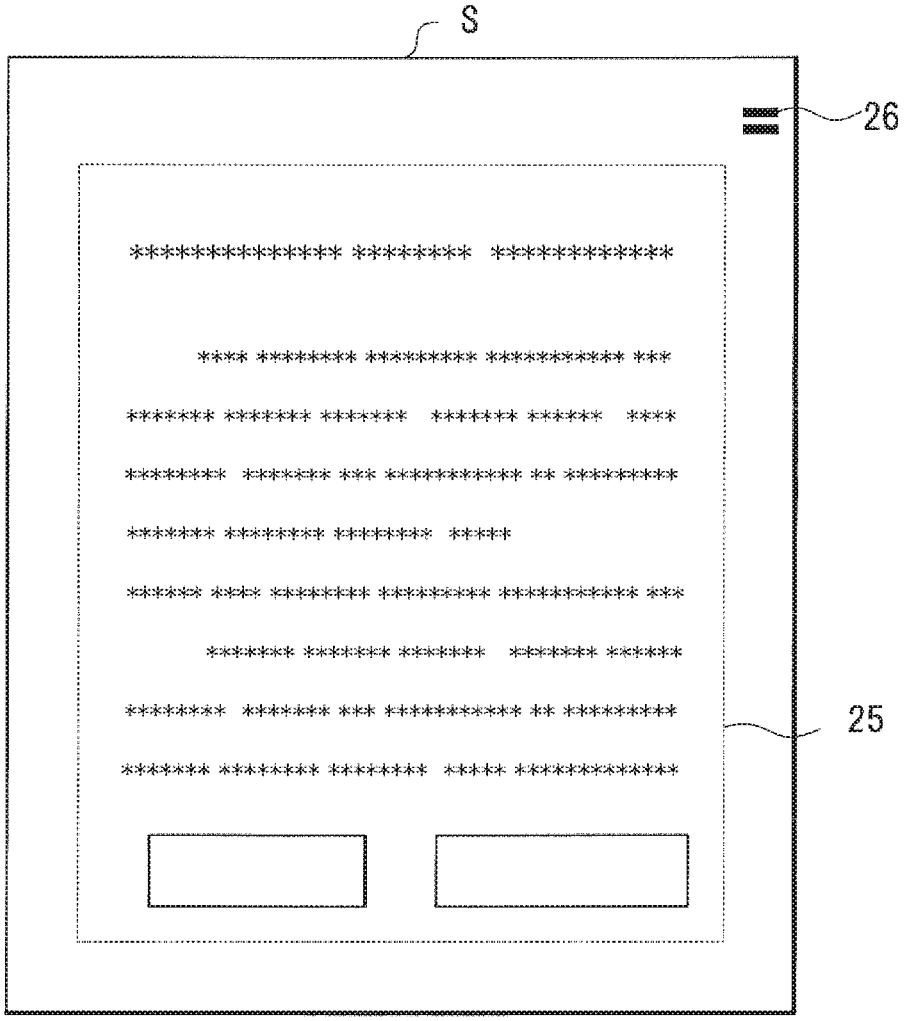
FIG. 2 illustrates an example of an image and a mark, both of which are formed on a reused sheet.

FIG. 2 illustrates an example of an image 25 and a mark 26, both of which are formed on the reused sheet S. The image 25 is printed with a decolorable colorant (decolorable toner, decolorable ink, and the like). The mark 26 is printed with a non-decolorable colorant that is not erased by heat.

The image forming apparatus prints the mark on the sheet at each time of printing with a decolorable colorant. For example, after the sheet is reused for n times, n numbers of the marks 26 are printed on the sheet. The mark 26 is printed according to the number of reuse for each of the front side and the rear side of the sheet. That is to say, the mark 26 serves as information indicating the number of reuse of each side.

The number of reuse of the sheet S is determined based on the image of the mark 26 read by the scanner 13. For example, the image data of both sides of the read sheet S (the image 25 and the mark 26) is stored in a storage unit in the erasing apparatus 10 on a per sheet basis. In addition, the number of reuse of the sheet is determined by counting the number of marks 26. Assuming that N is the maximum allowable number of reuse, the regular sheet S of which the number of reuse reaches N−1 is transported to the last reuse cassette 17 through the sixth transport path 146. The mark 26 is preferably printed at a corner of the sheet S in an unnoticeable size.

Instead of printing the mark 26 on the sheet S, an IC chip or the like may be affixed to the sheet S. When identifiable information of the same IC chip is read N−1 times, the corresponding sheet S may be desirably transported to the last reuse cassette 17.

In addition, there may be a case where the number of reuse is different for different sides of the same sheet. When the number of reuse is different for different sides of the sheet, the sheet is transported to the last reuse cassette 17 when the number of reuse of any side reaches N−1.

Figure 3:
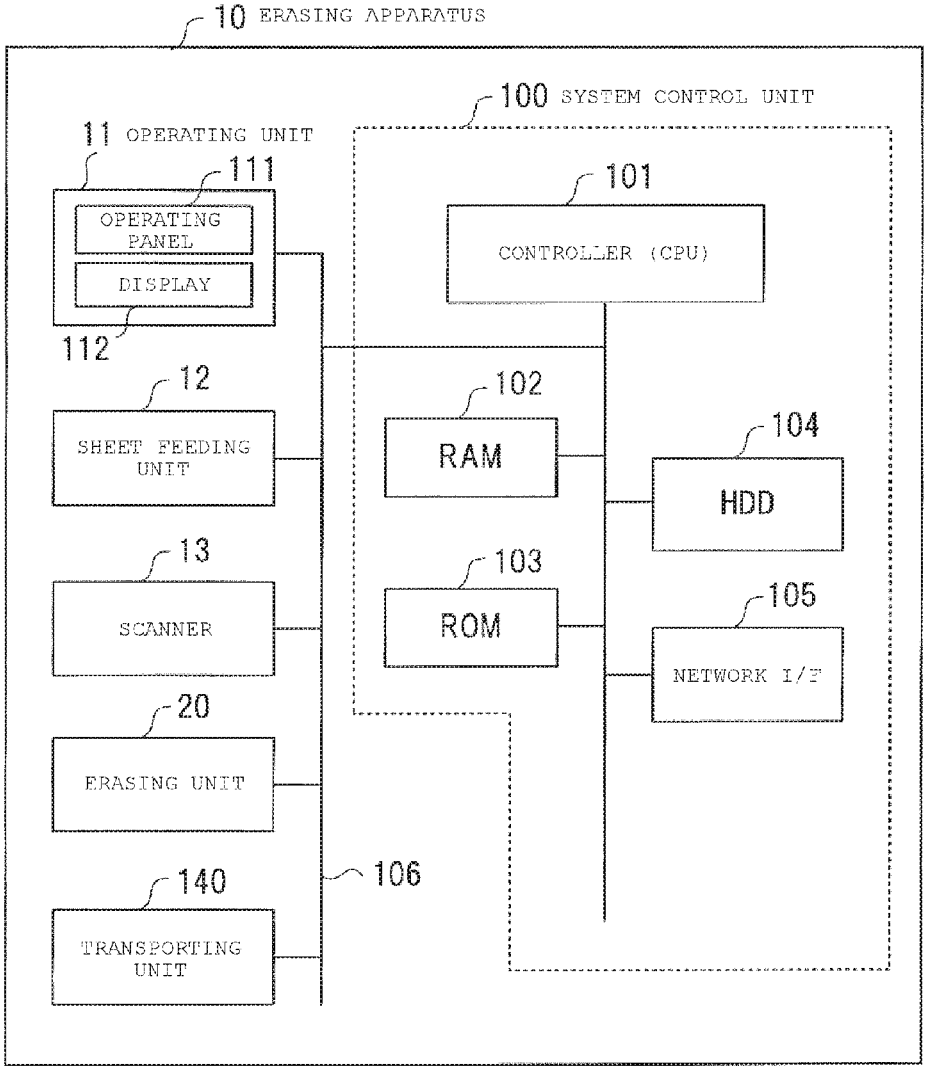
FIG. 3 is a block diagram illustrating a control system of the erasing apparatus.

FIG. 3 is a block diagram illustrating a control system of the erasing apparatus 10. The erasing apparatus 10 includes a system control unit 100 that controls each unit in whole. The system control unit 100, for example, includes a CPU 101 that is a controller, a random access memory (RAM) 102, a read-only memory (ROM) 103, a hard disk drive (HDD) 104, and a network interface (I/F) 105.

The operating unit 11, the sheet feeding unit 12, the scanner 13, the erasing unit 20, and a transporting unit 140 are connected to the system control unit 100 through a bus 106. The operating unit 11 includes an operating panel 111 and a display 112. The transporting unit 140 includes motors (not illustrated) that rotate the transport rollers 18 which are disposed on each of the transport paths 141 to 146.

The CPU 101 achieves various processing functions by executing a control program that is stored on the ROM 103. The RAM 102 is a main memory that functions as a working memory. The ROM 103 stores the control program and control data for controlling operation of the erasing apparatus 10 and achieving various processing functions.

The HDD 104 is a large capacity memory for data storage. The HDD 104, for example, stores the image data generated by the scanner 13 and data obtained from reading the mark 26. The network interface (I/F) 105 communicates with the image forming apparatus and other external apparatuses (PC and the like) through, for example, a local area network (LAN).

Next, a description will be provided for an operation of erasing the image on the sheet S in the erasing apparatus 10 and an operation of transporting the sheet S out of the erasing apparatus 10. The erasing apparatus 10 may obtain the number of reuse of the sheet by reading the mark 26. Assuming the allowable number of reuse is N, the erasing apparatus 10 identifies a sheet of which the number of reuse is N−1 transports the sheet to the last reuse cassette 17. Each sheet retained in the last reuse cassette 17 is treated as a sheet that may be post-processed (punched or stapled).

Specifically, when printing is performed on a sheet of which the number of reuse is N−1, the sheet is determined as nonreusable because the number of reuse has reached the allowable number of reuse N. Thus, after the Nth reuse, the sheet will be transported to the reject cassette 16 to be disused. Therefore, post-processing such as punching and stapling may be performed on the sheet of which the number of reuse is (N−1).

Figure 4:
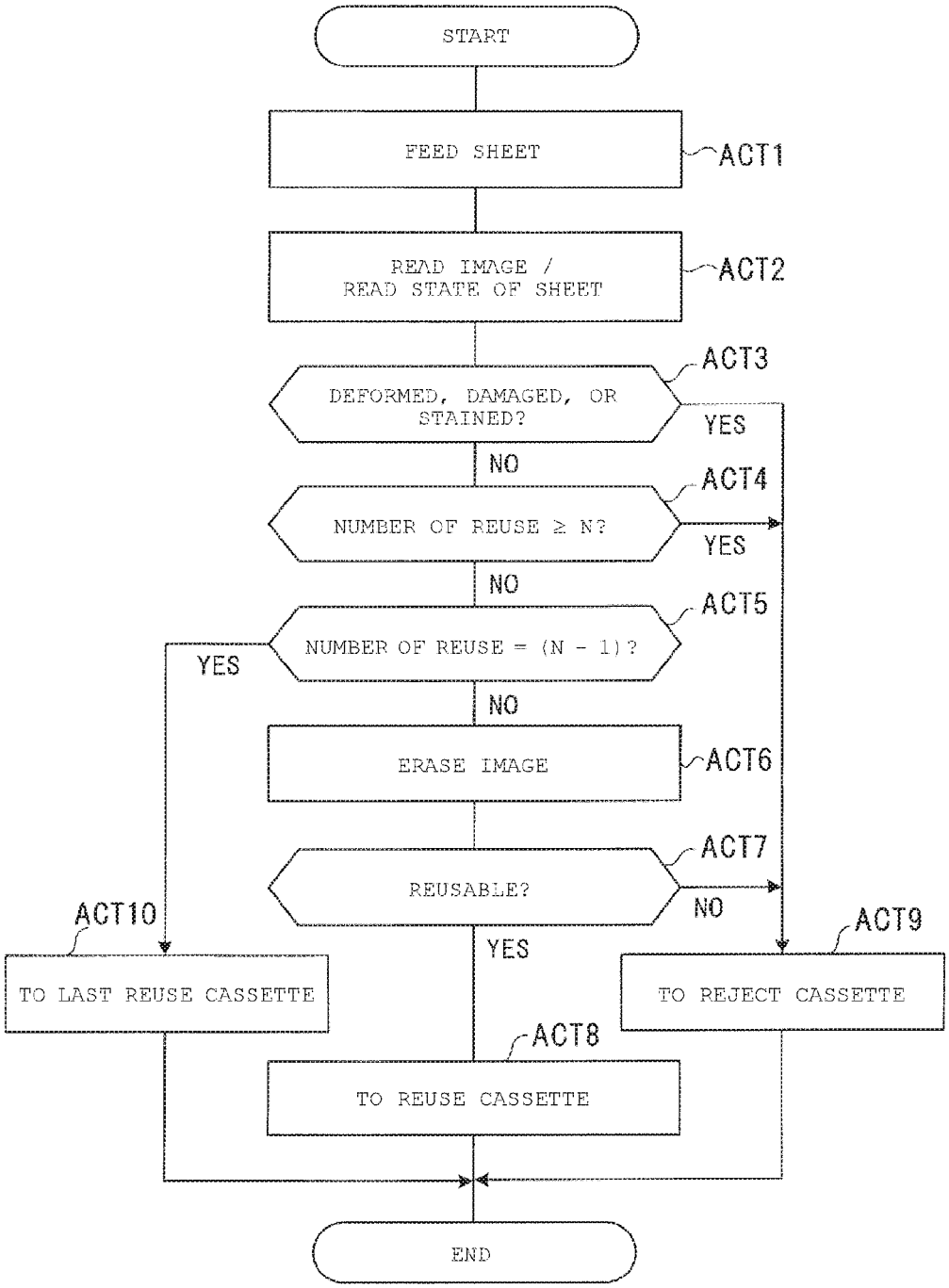
FIG. 4 is a flowchart illustrating an example sequence of operations of transporting a sheet in the erasing apparatus.

FIG. 4 is a flowchart illustrating an example sequence of operations of transporting the sheet S out of the erasing apparatus 10 under control of the CPU 101. In ACT1 in FIG. 4, the CPU 101 instructs the sheet feeding unit 12 to feed the sheet S. In ACT2, the CPU 101 instructs the scanner 13 to read the image (includes the mark 26) that is printed on the sheet S. The CPU 101 causes the read image data to be stored on the storage unit of the HDD 104 and the like. In ACT2, in addition, the CPU 101 reads the state of the sheet.

In ACT3, the CPU 101 determines whether the sheet S is deformed, damaged, or stained from the result of reading the state of the sheet. When the sheet S is determined as deformed, damaged, or stained (YES in ACT3), the CPU 101 determines that the sheet S is nonreusable. In the case of the nonreusable sheet S, the CPU 101 transitions to ACT9 and instructs the transporting unit 140 to transport the sheet S to the reject cassette 16.

When the sheet S is determined to be not deformed, not damaged, or not stained in ACT3 (NO in ACT3), the CPU 101 determines whether the number of reuse of the sheet S is less than the allowable number of reuse (N times) ACT4. In other words, in ACT4, the CPU 101 reads the mark 26 that is included in the image read in ACT2, and when the same mark 26 is read N times or more, the CPU 101 transitions to ACT9 and transports the sheet S to the reject cassette 16.

The scanner 13 may read the sheet S that is fed from the sheet feeding unit 12 or may read the sheet S after the image on the sheet S is erased by the erasing unit 20. Therefore, the CPU 101, when counting the number of reuse of the sheet S, determines the number of reuse from the information that is read at the time of feeding of the sheet S by the sheet feeding unit 12.

When the number of reuse is N or less in ACT4, the CPU 101 determines whether the number of reuse is N−1 in ACT5. In ACT5, when the number of reuse is determined to be N−1 (YES in ACT5), the CPU 101 transitions to ACT10 and instructs the transporting unit 140 to transport the sheet S to the last reuse cassette 17.

When the number of reuse is determined to be less than N−1 in ACT5 (NO in ACT5), the CPU 101 transports the sheet S to the erasing unit 20 through the second transport path 142 in ACT6. The erasing unit 20 erases the image on the sheet that is transported to the erasing unit 20. In ACT7, the CPU 101 reads again the sheet S with the scanner 13 and determines whether the sheet S reusable. If, for example, there is a residue that is not erased from the sheet S, or the sheet S is deformed, damaged, or stained, the sheet S is determined as nonreusable in ACT7. The CPU 101 then transitions to ACT9 and instructs the transporting unit 140 to transport the sheet S to the reject cassette 16.

When the sheet S is determined to be reusable in ACT7 (YES in ACT7), the CPU 101 proceeds to ACT8. In ACT8, the CPU 101 instructs the transporting unit 140 to transport the sheet S to the reuse cassette 15, and then ends the operation. The mark 26 remains because the mark 26 is not erased. However, since the mark 26 is small, the mark 26 may be ignored by a user even though the mark 26 remains.

As described above, a regular sheet of which the number of reuse has reached N−1 is retained in the last reuse cassette 17. Since the sheet that is retained in the last reuse cassette 17 will be reused for the last time, the sheet may be post-processed (punched or stapled). Therefore, the sheets retained in the last reuse cassette 17 are preferentially used as sheets for post-processing.

When there is a sheet transported to the last reuse cassette 17, a message such as "Please use the sheets in the last reuse cassette for post-processing" may be displayed on the display 112 of the operating unit 11.

Figure 5:
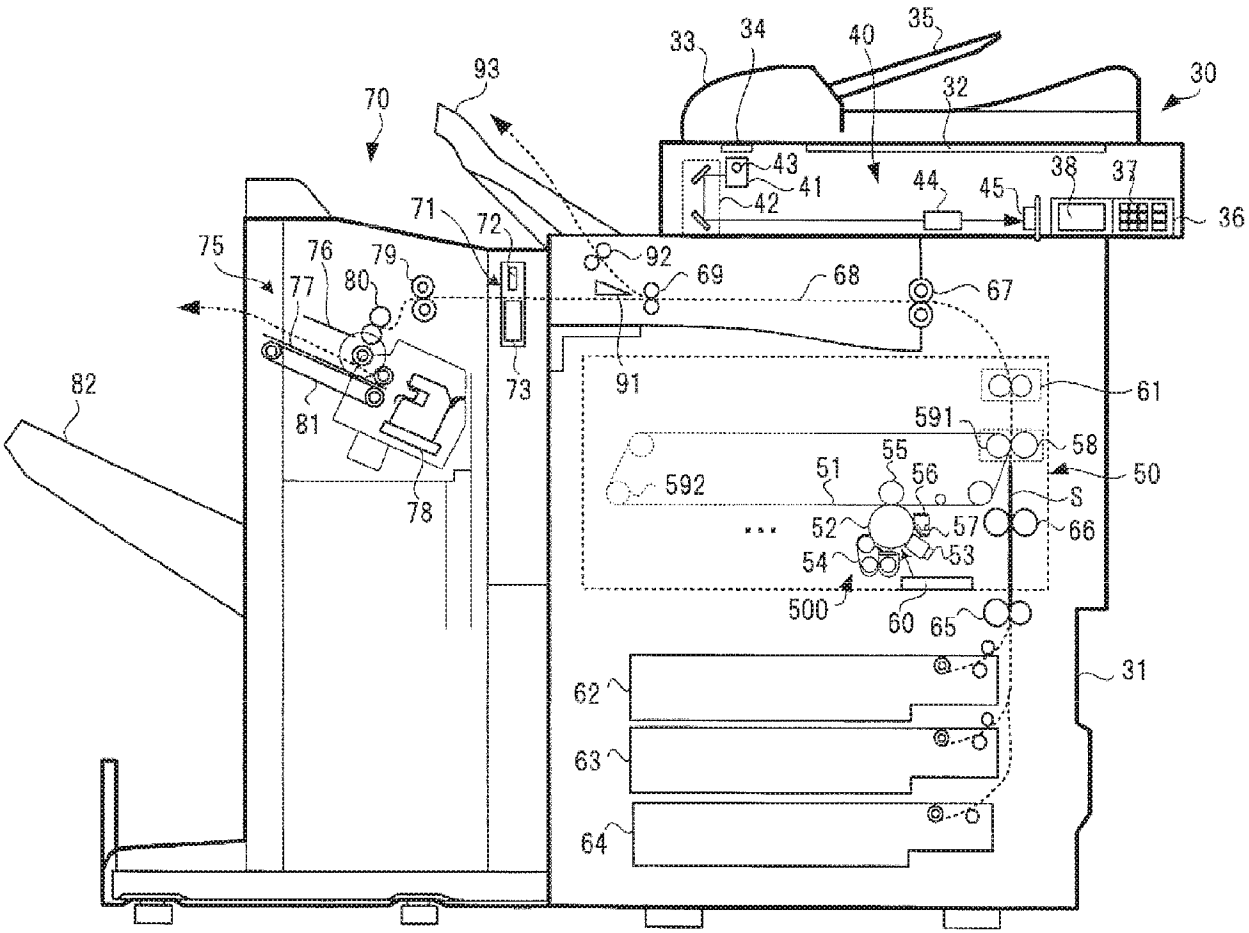
FIG. 5 illustrates an example configuration of an image forming apparatus and a finisher according to a first embodiment.

Next, the configuration of the image forming apparatus according to the first embodiment will be described with reference to FIG. 5. In FIG. 5, an image forming apparatus 30 is, for example, a multifunction peripheral (MFP) that is a compound machine, a printer, a photocopier or the like. In the description below, the image forming apparatus 30 will be assumed to be an MFP.

A finisher 70 may be connected to the MFP 30. Connecting the finisher 70 to the MFP 30 enables post-processing such as punching and stapling. A sheet on which an image is formed by the MFP 30 is transported to the finisher 70. The finisher 70 performs post-processing such as punching and/or stapling on the sheet that is supplied from the MFP 30. The finisher 70 includes a punching unit 71 and/or a stapling unit 75. The punching unit 71 makes a punch hole on a sheet. The stapling unit 75 staples a bundle of sheets.

A document table 32 is arranged above a main body 31 of the MFP 30. An automatic document feeder (ADF) 33 is disposed on the document table 32 in an openable and closable manner. A glass 34 that is a window for reading a document is fixed under the ADF 33. A sheet feeding tray 35, on which a document may be placed, is disposed in the ADF 33. An operating panel 36 is positioned above the main body 31. The operating panel 36 includes various operational keys 37 and a touch panel display unit 38.

A scanner unit 40 that functions as an image reading apparatus is provided under the document table 32 of the MFP 30. The scanner unit 40 scans a document that is transported by the ADF 33. In addition, the scanner unit 40 scans a document by scanning a side of the document that is mounted on the document table 32. The scanner unit 40 includes a first carriage 41 and a second carriage 42.

The first carriage 41 incorporates a light source 43 for irradiating the side of the document. The light source 43 irradiates the document with light. The light source 43 uses, for example, an LED. Light reflected by the document is reflected off of a mirror that is disposed in the first carriage 41 and the second carriage 42. The light reflected by the mirror is guided to an image sensor 45 through a lens 44. The image sensor 45 includes, for example, a charge coupled device (CCD) line sensor.

The reflective light from the document is converted into electrons by the image sensor 45. By the conversion of light into electrons, an electrical signal is output from the image sensor 45. The electrical signal output from the image sensor 45 is subject to analog-processing and is converted into a digital signal. The digital signal is subject to image-processing, and the image data is generated.

A printer unit 50 is provided in the MFP 30. The printer unit 50 includes a photoreceptor drum, a laser, and the like. The printer unit 50 processes the image data generated by the scanner unit 40 or transmitted by a personal computer (PC), or the like. The printer unit 50 forms an image on a recording medium based on the processed image data. Hereinafter, the sheet S will be described as a recording medium.

The printer unit 50 is provided with a loop transfer belt 51 that functions as an image carrier. An image forming unit 500 is disposed downstream of the transfer belt 51. An electrostatic charger 53, a developer 54, a primary transfer roller 55, a cleaner 56, a blade 57, and the like are suitably arranged around the photoreceptor drum 52.

The electrostatic charger 53 uniformly electrifies the entire surface of the photoreceptor drum 52. The image forming unit 500 exposes the surface of the photoreceptor drum 52 by scanning the surface of the photoreceptor drum 52 with a laser beam from a laser 60. By the exposure, an electrostatic latent image is formed on the photoreceptor drum 52. The laser 60 scans the laser beam based on the image data read by the scanner unit 40.

The developer 54 includes a mixer and a developing roller. The developing roller supplies a dual component developer toner including a toner and a carrier to the photoreceptor drum 52.

The toner image on the photoreceptor drum 52 is transferred to the transfer belt 51 by the primary transfer roller 55. The cleaner 56 removes the remaining toner on the surface of the photoreceptor drum 52 with the blade 57. The toner image that is on the transfer belt 51 is then transferred to the sheet S by a secondary transfer roller 58. The transfer belt 51 is stretched over a drive roller 591 and a driven roller 592. The transfer belt 51 is circularly moved by rotation of the drive roller 591.

The toner image that is transferred to the sheet S is fixed on the sheet S by a fixer 61. The fixer 61 includes a fixing roller and a press roller. The sheet S passes through between the fixing roller and the press roller. The sheet S is heated and pressed to fix the toner image on the sheet S.

The printer unit 50, when forming a color image, includes a plurality of image forming units 500 for, for example, yellow (Y), magenta (M), cyan (C), and blue (B). Each of the plurality of image forming units 500 are arranged facing the transfer belt 51 from the upstream side to the downstream side of the transfer belt 51. Each of the plurality of image forming units 500 has the same configuration. Thus, only one image forming unit 500 is illustrated in FIG. 5.

The image forming unit for yellow (Y) forms an image with a non-decolorable yellow colorant. The image forming unit for magenta (M) forms an image with a non-decolorable magenta colorant. The image forming unit for cyan (C) forms an image with a non-decolorable cyan colorant. The image forming unit for blue (B) forms an image with a decolorable blue-based colorant (may be called a B toner hereinafter).

The image forming units for yellow, magenta, and cyan may form a monochrome (black) image by mixing each color thereof. In a case of reusing a sheet, an image may be formed with the decolorable B toner by the image forming unit for blue (B). When an image is formed on a sheet with the decolorable colorant, the sheet may be reused by erasing the image with the erasing apparatus 10.

The mark 26 that indicates the number of reuse is printed with a non-decolorable toner at an unnoticeable position (a corner or the like) on the sheet S. When the sheet is reused, the number of marks 26 is increased for each time of reuse.

A sheet feeding cassette that accommodates various sizes of sheets is provided in the lower portion of the main body 31. The sheet feeding cassette includes a plurality of cassettes 62, 63, and 64. The number of cassettes is not limited to three. The cassette 62 accommodates, for example, a new sheet. The cassette 63 accommodates a sheet that was retained in the reuse cassette 15 of the erasing apparatus 10. The cassette 64 accommodates a sheet that was retained in the last reuse cassette 17 of the erasing apparatus 10.

In the description below, a sheet that the cassette 63 accommodates is called a reuse sheet. A sheet that the cassette 64 accommodates is called a last reuse sheet. A last reuse sheet is a regular sheet of which the number of reuse has reached N−1.

A transport roller 65 and a resist roller 66 are arranged between the cassette 62 and the secondary transfer roller 58. The transport roller 65 transports the sheet S that is taken out of each of the cassettes 62, 63, and 64 to the resist roller 66. The resist roller 66 transports the sheet S to the secondary transfer roller 58. The secondary transfer roller 58 transfers the toner image to the sheet S. The sheet S on which the toner image is fixed by the fixer 61 is discharged by a sheet discharge roller 67.

When the finisher 70 is connected to the rear of the MFP 30, a sheet can be transported to the finisher 70 through a transport path 68 and a transport roller 69. The sheet S that does not need to be post-processed is discharged to a fixed tray 93. A gate 91 and a discharge roller 92 are positioned to guide the sheet S to the fixed tray 93. The gate 91 is positioned between the punching unit 71 and the transport roller 69 in the main body 31. By switching the gate 91, the sheet S is selectively transported to the finisher 70 or the fixed tray 93.

In the embodiment, the sheet S is transported from one of the sheet feeding cassettes 62, 63, and 64 to the sheet discharge roller 67. Therefore, a side of the sheet feeding cassettes 62, 63, and 64 is defined as the upstream direction of transport of the sheet. In addition, a side of the sheet discharge roller 67 is defined as the downstream direction of transport of the sheet.

Next, an example of the finisher 70 will be described. The finisher 70 includes the punching unit 71 and/or the stapling unit 75. The punching unit 71 includes a punching blade 72 and a dust box 73. The punching unit 71 is disposed between the MFP 30 and the stapling unit 75.

The punching blade 72 of the punching unit 71 goes down in order to make a punch hole on the sheet. Punch wastes produced by punching fall into the dust box 73. The sheet S that is discharged from the punching unit 71 is transported to the stapling unit 75.

The stapling unit 75 includes a waiting tray 76, a processing tray 77, and a stapler 78. An entrance roller 79 that is disposed in a transport entrance of the stapling unit 75 receives the sheet S that is discharged from the punching unit 71. The entrance roller 79 is driven by a motor (not illustrated).

A sheet feeding roller 80 is positioned on the downstream side of the entrance roller 79. The sheet S that the entrance roller 79 receives is transported to the waiting tray 76 through the sheet feeding roller 80. The sheet feeding roller 80 is driven by a motor (not illustrated). The processing tray 77 is positioned below the waiting tray 76. The sheet S that falls from the waiting tray 76 may be stacked on the processing tray 77.

The waiting tray 76 has an openable structure while the sheet S is stacked thereon. When a predetermined number of sheets S are stacked on the waiting tray 76, the waiting tray 76 is opened, and the sheet S falls onto the processing tray 77. The sheet that falls onto the processing tray 77 is guided to the stapler 78 by a transport belt 81 and is stapled. The transport belt 81 is driven by a motor (not illustrated).

The transport belt 81 rotates in one direction when guiding the sheet S to the stapler 78 and in an opposite direction when discharging the stapled sheet S. The stapled sheet S is transported to a storage tray 82 by the transport belt 81. The storage tray 82 may be raised or lowered.

When stapling is not necessary, and only punching is performed, the sheet S is not guided to the stapler 78 and is discharged to the storage tray 82 by a rotating roller. When only stapling is performed without punching, the punching blade 72 of the punching unit 71 is placed at a standby position from the transport path of the sheet. The sheet S is transported to the stapling unit 75 without being punched and is stapled by the stapler 78.

Figure 6:
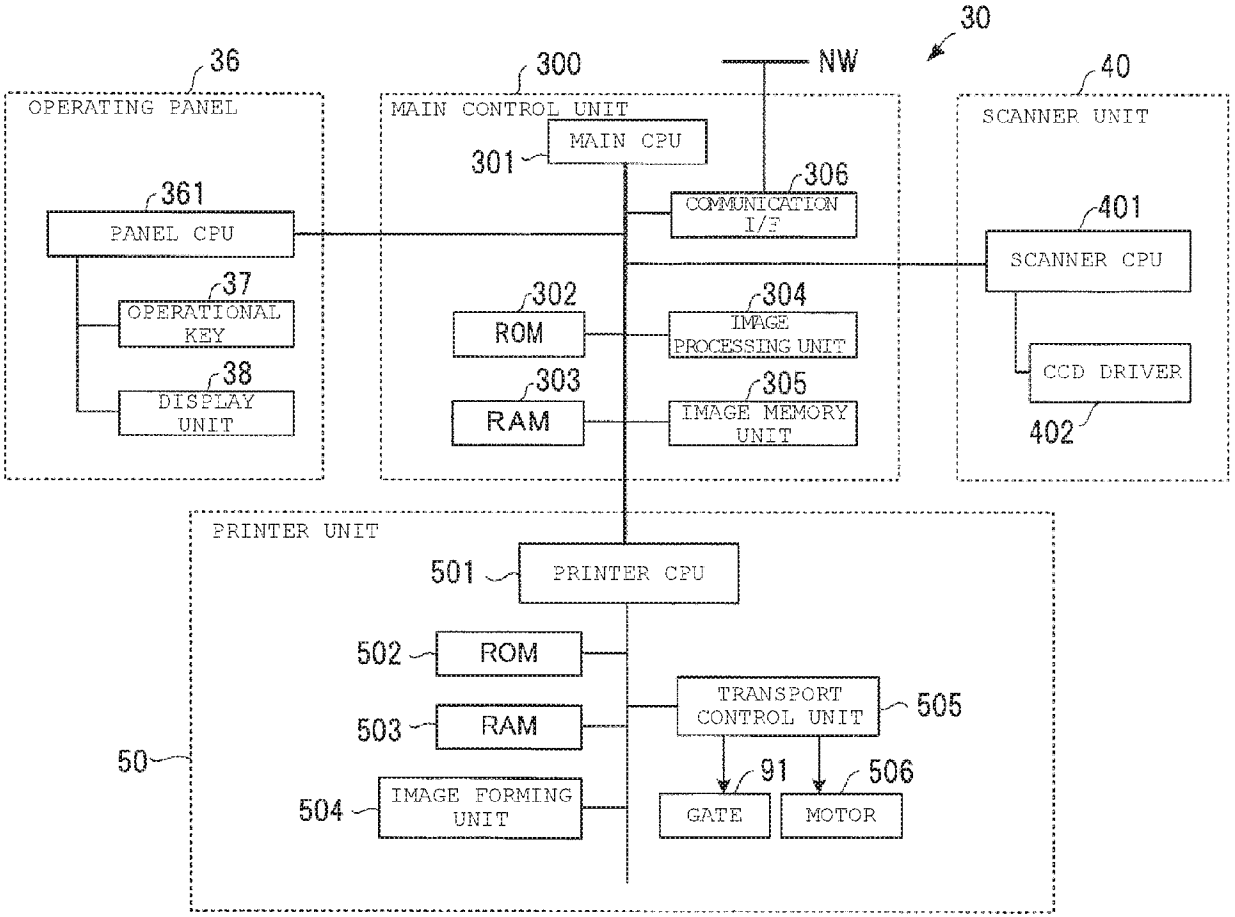
FIG. 6 is a block diagram illustrating a control system of the image forming apparatus.

FIG. 6 is a block diagram illustrating a control system of the MFP 30 according to the first embodiment. In FIG. 6, the MFP 30 includes a main control unit 300, the operating panel 36, the scanner unit 40, and the printer unit 50. The control system of the MFP 30 includes a plurality of CPUs of a main CPU 301 in the main control unit 300, a panel CPU 361 of the operating panel 36, a scanner CPU 401 of the scanner unit 40, and a printer CPU 501 of the printer unit 50. The control system performs communication between each CPU.

The main control unit 300 includes the main CPU 301, a ROM 302, a RAM 303, an image processing unit 304, an image memory unit 305 such as an HDD, a communication interface (I/F) 306, and the like. The main CPU 301 controls the entire operation of the MFP 30. In addition, the main CPU 301 may control the finisher 70. The ROM 302 stores a control program and the like. The RAM 303 temporarily stores data when the main CPU 301 performs various processes.

The image processing unit 304 processes the image data generated by the scanner unit 40 and the image data transmitted from a PC and the like. As a process for the image data, for example, an image conversion process of enlarging or shrinking the image may be performed. The image memory unit 305 compresses and stores the image data generated by the scanner unit 40 and the image data transmitted from a PC (document data, drawing image data, and the like).

The image data that is stored in the image memory unit 305 is input into the image processing unit 304. The image processing unit 304 performs various types of image processing. The printer unit 50 prints the image data subject to image-processing on the sheet. The communication I/F 306 may be connected to the erasing apparatus 10 and the like through a network NW such as a LAN.

The operating panel 36 includes the panel CPU 361 that is connected to the main CPU 301, the various operational keys 37, and the display unit 38 which may be configured of a liquid crystal display or the like. The operational keys 37 include a ten key and the like for, for example, instructing the number of prints. The display unit 38 has a function of a touch panel. Instructions for a sheet size, printing magnification, simplex printing, and duplex printing are input on the display unit 38. In addition, selecting a type of a sheet, specifying a post-processing mode, specifying a printing mode, and the like are performed on the display unit 38 (will be described in detail later).

The scanner unit 40 includes the scanner CPU 401 and a CCD driver 402 that drives the image sensor 45. The CCD driver 402 scans the image of the document by driving the image sensor 45 and converts the image into image data.

The printer unit 50 includes the printer CPU 501, a ROM 502, a RAM 503, an image forming unit 504, a transport control unit 505, and the like. The printer unit 50 performs printing on a sheet in cooperation with the main CPU 301. The ROM 502 stores a program and the like for controlling the printer unit 50. The RAM 503 is a storage unit and temporarily stores data when the printer CPU 501 performs various processes.

The printer CPU 501 controls the image forming unit 504. The image forming unit 504 is a generic term for a plurality of image forming units for yellow (Y), magenta (M), cyan (C), and blue (B). The image forming unit 504 forms an image by controlling the photoreceptor drum 52, the electrostatic charger 53, the developer 54, the secondary transfer roller 58, and the like. In addition, the image forming unit 504 controls the temperature and rotation of a heating roller of the fixer 61.

The gate 91 and a motor 506 are connected to the transport control unit 505. The transport control unit 505 controls transport of the sheet S by driving the motor 506. In addition, the transport control unit 505 switches the gate 91 and guides the sheet S to the finisher 70 or the fixed tray 93.

Next, a description will be provided for an image forming operation performed by the MFP 30 and a post-processing operation performed by the finisher 70 according to the embodiment.

Figure 7:
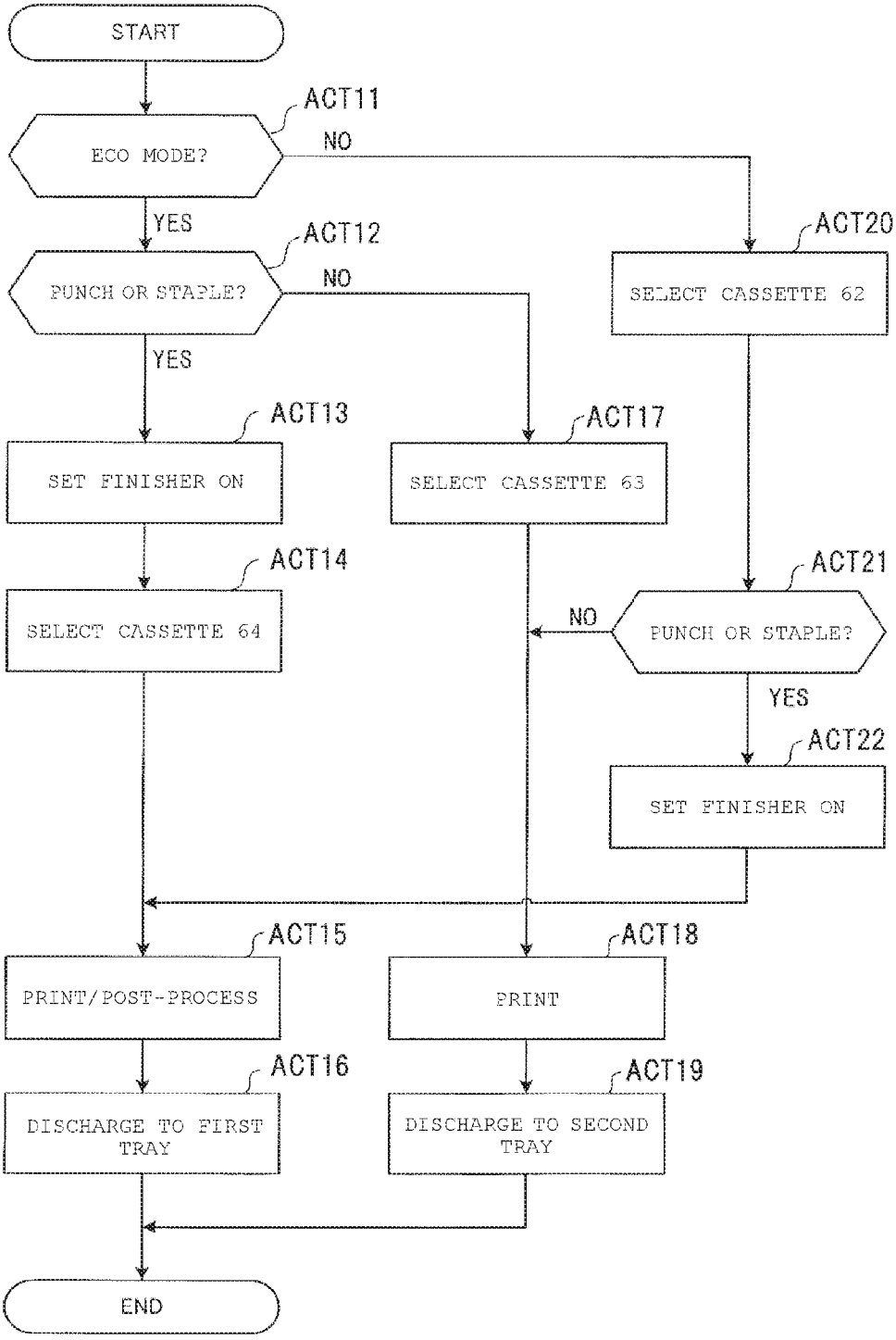
FIG. 7 is a flowchart illustrating an example sequence of operations performed by the image forming apparatus and the finisher.
Figure 8:
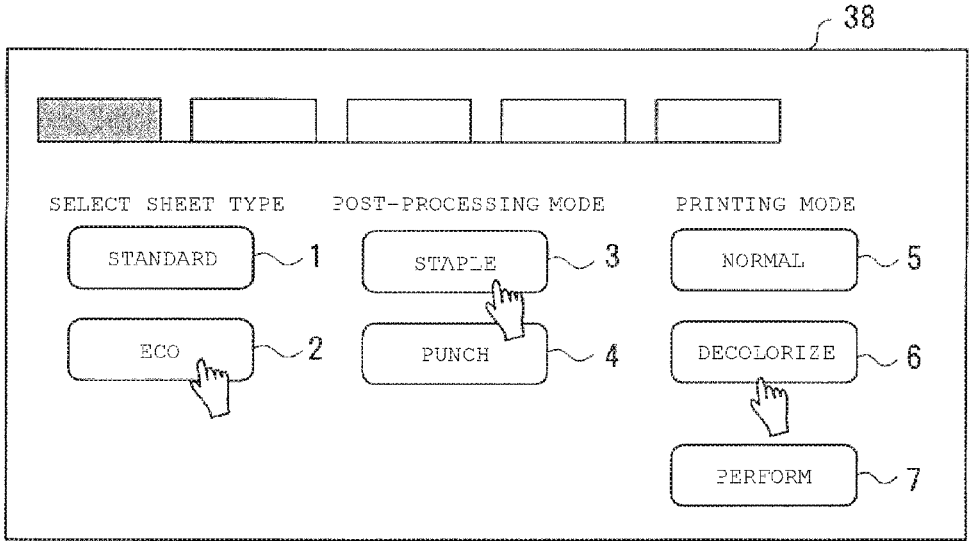
FIG. 8 illustrates an example of a display screen on an operating unit of the finisher.

FIG. 7 is a flowchart illustrating an example sequence of operations performed by the MFP 30 and the post-processing operation performed by the finisher 70 according to the embodiment. Processes in FIG. 7 are performed under control of a control unit that mainly includes the main CPU 301 and the printer CPU 501. FIG. 8 illustrates an example of a display screen that is displayed on the display unit 38 of the operating panel 36 in the MFP 30.

First, operations on the menu screen will be described with reference to FIG. 8. Displaying choices for a type of a sheet, a post-processing mode and a printing mode may be performed in the operating panel 36 by displaying the menu screen in FIG. 8 on the display unit 38.

On the menu screen in FIG. 8, a type of a sheet may be selected by operating a standard button 1 or an eco button 2. That is to say, a selection may be made between printing of an image on a new sheet by touching the standard button 1 and printing of an image on a reuse sheet or a last reuse sheet by touching the eco button 2.

Regarding designations of a post-processing mode, a designation of stapling a sheet with the finisher 70 may be made by touching a staple button 3 on the menu screen. A designation of punching a sheet may be made by touching a punch button 4. When the staple button 3 and the punch button 4 are not touched, post-processing is not performed.

Regarding designations of a printing mode, a designation of printing an image on a sheet with a non-decolorable colorant may be made by touching a normal button 5 on the menu screen. A designation of printing an image on a sheet with a decolorable colorant (B toner) may be made by touching a decolorize button 6.

When a perform button 7 is touched after selection of a type of a sheet, a post-processing mode and a printing mode is finished, the MFP 30 starts forming an image, and the finisher 70 starts the post-processing operation according to the selections.

In ACT11 in FIG. 7, the main CPU 301 determines the selected type of a sheet. For example, when a user touches the eco button 2 on the menu screen in FIG. 8, the main CPU 301 determines that an image is printed on a reuse sheet or a last reuse sheet (YES in ACT11). In ACT12, the main CPU 301 determines whether post-processing is to be performed.

That is to say, when the user touches at least one of the staple button 3 and the punch button 4 on the menu screen in FIG. 8 (YES in ACT12), the main CPU 301 controls the finisher 70. In ACT13, the main CPU 301 sets the finisher 70 into an operable state (ON).

In ACT14, the main CPU 301 selects the cassette 64. The cassette 64 accommodates a last reuse sheet. Since a last reuse sheet becomes nonreusable after being reused once more, a last reuse sheet may be stapled or punched. Therefore, when the eco button 2 is selected, and post-processing is specified, the cassette 64 is preferentially selected.

Figure 9:
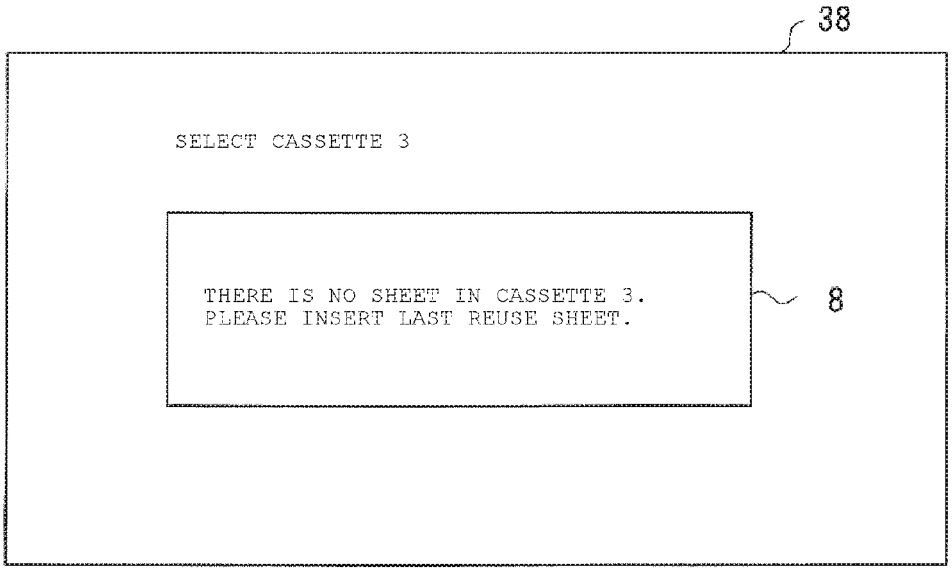
FIG. 9 illustrates another example of a display screen on the operating unit.

When there is no last reuse sheet accommodated in the cassette 64, a message 8 is displayed on the display unit 38 of the operating panel 36 as illustrated in FIG. 9. In FIG. 9, a message 8 such as "There is no sheet in cassette 3. Please insert last reuse sheets." is displayed. A sheet sensor that is disposed in the cassette 64 determines whether there is a sheet in the cassette 64.

Next, in ACT15, the printer CPU 501 performs printing by controlling the printer unit 50. That is to say, the printer CPU 501 prints an image on a last reuse sheet by controlling the image forming unit 504. Printing on a last reuse sheet is performed in a printing mode that is specified in FIG. 8. For example, printing is performed with a non-decolorable colorant when the normal button 5 is touched, and printing is performed with a decolorable colorant (B toner) when the decolorize button 6 is touched. In ACT15, the main CPU 301 staples or punches a sheet by controlling the finisher 70. In ACT16, the finisher 70 discharges a stapled or a punched sheet to the storage tray 82 (first tray).

Meanwhile, when punching and stapling are not specified in ACT12 (NO in ACT12), the main CPU 301 selects the cassette 63 in ACT17. The cassette 63 accommodates a reuse sheet. Since a reuse sheet may be reused for two or more times, a reuse sheet should not be selected for being stapled or punched. Therefore, when the eco button 2 is selected, and post-processing is not specified, the main CPU 301 selects the cassette 63.

In ACT18, the printer CPU 501 performs printing by controlling the printer unit 50. That is to say, the printer CPU 501 prints an image on a reuse sheet by controlling the image forming unit 504. Printing on a reuse sheet is performed in the printing mode that is specified in FIG. 8 (with a non-decolorable colorant or a decolorable colorant (B toner)).

In ACT19, the transport control unit 505 switches the gate 91. In this case, the gate 91 is switched in a manner in which a sheet is transported to the fixed tray 93 (second tray). Therefore, a reuse sheet on which printing is performed is not transported to the finisher 70 and is discharged to the fixed tray 93 (second tray).

When the user touches the standard button 1 on the menu screen in FIG. 8, the main CPU 301 determines that an image is printed on a new sheet (NO in ACT11). In ACT20, the main CPU 301 selects the cassette 62. The cassette 62 accommodates a new sheet.

In ACT21, the main CPU 301 determines whether post-processing is to be performed. That is to say, when the user touches at least one of the staple button 3 and the punch button 4 on the menu screen in FIG. 8 (YES in ACT21), the main CPU 301 controls the finisher 70. In ACT22, the main CPU 301 sets the finisher 70 into an operable state (ON).

After ACT22, the printer CPU 501 prints an image on a new sheet in ACT15. Printing on a new sheet is performed in a printing mode that is specified in FIG. 8. In ACT15, the finisher 70 staples or punches a sheet. In ACT16, the finisher 70 discharges a stapled or a punched sheet to the storage tray 82 (first tray).

When punching and stapling are not specified in ACT21 (NO in ACT21), the process flow proceeds to ACT18. In ACT18, the printer CPU 501 prints an image on a sheet. Printing on a new sheet is performed in a printing mode that is specified in FIG. 8. In ACT19, a sheet on which printing is performed is discharged to the fixed tray 93 (second tray).

When there is no sheet accommodated in the case where the cassette 63 is selected in ACT17 or in the case where the cassette 62 is selected in ACT20, a message similar to that in FIG. 9 may be displayed on the display unit 38.

When the sheets in the cassette 62 are used up during the printing in which the cassette 62 is selected in ACT20, and punching or stapling is specified, printing may be continued by switching the cassette 62 automatically to the cassette 64 and using a last reuse sheet preferentially.

The image forming apparatus according to the embodiment, as described so far, may preferentially use a last reuse sheet when a last reuse sheet is present in a specified cassette (cassette 64), and post-processing such as punching and stapling is specified.

Types of sheets to insert into the cassette 62, 63, and 64 may be desirably set in advance. Then, a corresponding cassette may be desirably selected according to the result of determinations in ACT11 and ACT12.

Second Embodiment

Next, the configuration of an image forming apparatus according to a second embodiment will be described with reference to FIG. 10. The image forming apparatus 30 in FIG. 10 includes two of the cassettes 62 and 63 as a sheet feeding cassette. The cassette 62 accommodates a new sheet, and the cassette 63 accommodates a reuse sheet and a last reuse sheet.

A scanner 507 that is a reading unit is disposed in front of the resist roller 66. The scanner 507 reads the mark 26 that is printed on a reuse sheet (or a last reuse sheet) and determines the number of reuse. When the mark 26 is present on both sides of a sheet, the scanner 507 reads the mark 26 for each of the front side and the rear side of a sheet.

Other configurations are the same as those in FIG. 5 and thus will not be described in detail.

In the second embodiment, the scanner 507 that is disposed in the MFP 30 determines whether a sheet that is accommodated in the cassette 63 is a reuse sheet or a last reuse sheet.

Figure 11:
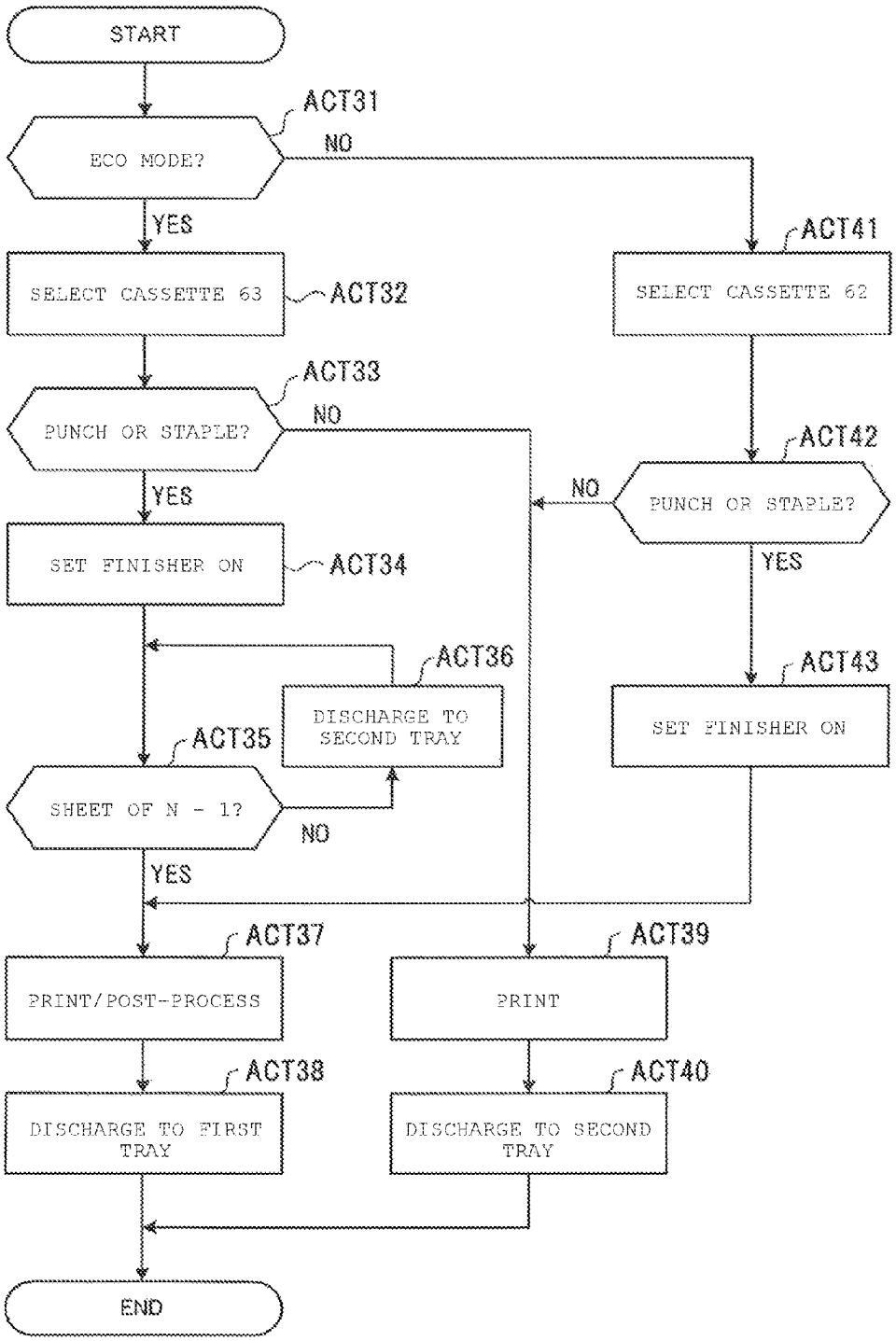
FIG. 11 is a flowchart illustrating an example sequence of operations performed by the image forming apparatus and the finisher in the second embodiment.

FIG. 11 is a flowchart illustrating an example sequence of operations performed by the MFP 30 and the finisher 70 according to the second embodiment. In ACT31 in FIG. 11, the main CPU 301 determines the selected type of a sheet. For example, when the user touches the eco button 2 on the menu screen in FIG. 8 (YES in ACT31), the main CPU 301 determines that an image is to be printed on a reuse sheet or a last reuse sheet. In ACT32, the main CPU 301 selects the cassette 63. In ACT33, the main CPU 301 determines whether post-processing is to be performed.

That is to say, when the user touches at least one of the staple button 3 and the punch button 4 on the menu screen in FIG. 8 (YES in ACT33), the main CPU 301 controls the finisher 70. In ACT34, the main CPU 301 sets the finisher 70 into an operable state (ON).

In ACT35, since the cassette 63 accommodates a reuse sheet and a last reuse sheet, the printer CPU 501 determines the number of reuse of a sheet from the result of reading of the mark 26 by the scanner 507. That is to say, in ACT35, the printer CPU 501 determines whether the number of reuse of a sheet in the cassette 63 is N−1. When there is a sheet of which the number of reuse is not N−1, printing is not performed on the sheet, and the sheet is discharged to the fixed tray 93 (second tray) in ACT36.

When the sheet in the cassette 63 is determined to be a last reuse sheet in ACT35 (YES in ACT35), the printer CPU 501 prints an image on a last reuse sheet by controlling the image forming unit 504 in ACT37. Printing on a last reuse sheet is performed in the printing mode that is specified in FIG. 8. For example, printing is performed with a non-decolorable colorant when the normal button 5 is touched, and printing is performed with a decolorable colorant (B toner) when the decolorize button 6 is touched.

In ACT37, the transport control unit 505 switches the gate 91. The gate 91 is switched in a manner in which a sheet is transported to the finisher 70. Therefore, a last reuse sheet on which printing is performed is transported to the finisher 70. The main CPU 301 controls the finisher 70 to be subject to processes of staple or punch on a sheet. In ACT38, the finisher 70 discharges a sheet subject to the processes of staple or punch to the storage tray 82 (first tray).

Meanwhile, when punching and stapling are not specified in ACT33 (NO in ACT33), the process flow proceeds to ACT39. In ACT39, the printer CPU 501 prints an image on a reuse sheet or a last reuse sheet by controlling the image forming unit 504. Printing on a reuse sheet or a last reuse sheet is performed in the printing mode that is specified in FIG. 8 (with a non-decolorable colorant or a decolorable colorant (B toner)).

In ACT40, the transport control unit 505 switches the gate 91. The gate 91 is switched in a manner in which a sheet is transported to the fixed tray 93 (second tray). Therefore, a sheet on which printing is performed is discharged to the fixed tray 93 (second tray).

When the user touches the standard button 1 on the menu screen in FIG. 8 (NO in ACT31), the main CPU 301 determines that an image is printed on a new sheet. In ACT41, the main CPU 301 selects the cassette 62. The cassette 62 accommodates a new sheet.

In ACT42, the main CPU 301 determines whether post-processing is to be performed. That is to say, when the user touches at least one of the staple button 3 and the punch button 4 on the menu screen in FIG. 8 (YES in ACT42), the main CPU 301 controls the finisher 70. In ACT43, the main CPU 301 sets the finisher 70 into an operable state (ON).

After ACT43, the process flow proceeds to ACT37, and the printer CPU 501 prints an image on a new sheet. Printing on a new sheet is performed in a printing mode that is specified in FIG. 8. In ACT37, the finisher 70 staples or punches a sheet. In ACT38, the finisher 70 discharges a sheet subject to the processes of staple or punch to the storage tray 82 (first tray).

When punching and stapling are not specified in ACT42 (NO in ACT42), the process flow proceeds to ACT39. In ACT39, the printer CPU 501 prints an image on a new sheet. Printing on a new sheet is performed in the printing mode that is specified in FIG. 8. In ACT40, a sheet on which printing is performed is discharged to the fixed tray 93 (second tray).

In the image forming apparatus according to the second embodiment, as described so far, a reuse sheet and a last reuse sheet are accommodated in a specified cassette (the cassette 63 in the present example). In addition, when post-processing such as punching and stapling is specified, printing is preferentially performed on a last reuse sheet based on the result of reading by the scanner 507, and post-processing is performed. When post-processing is not specified, printing may be performed by using a reuse sheet or a last reuse sheet.

Not limited to the embodiments described so far, various applications may be carried out. For example, as illustrated in FIG. 12, the gate 91, the discharge roller 92, and the fixed tray 93 may be disposed in the finisher 70.

Figure 12:
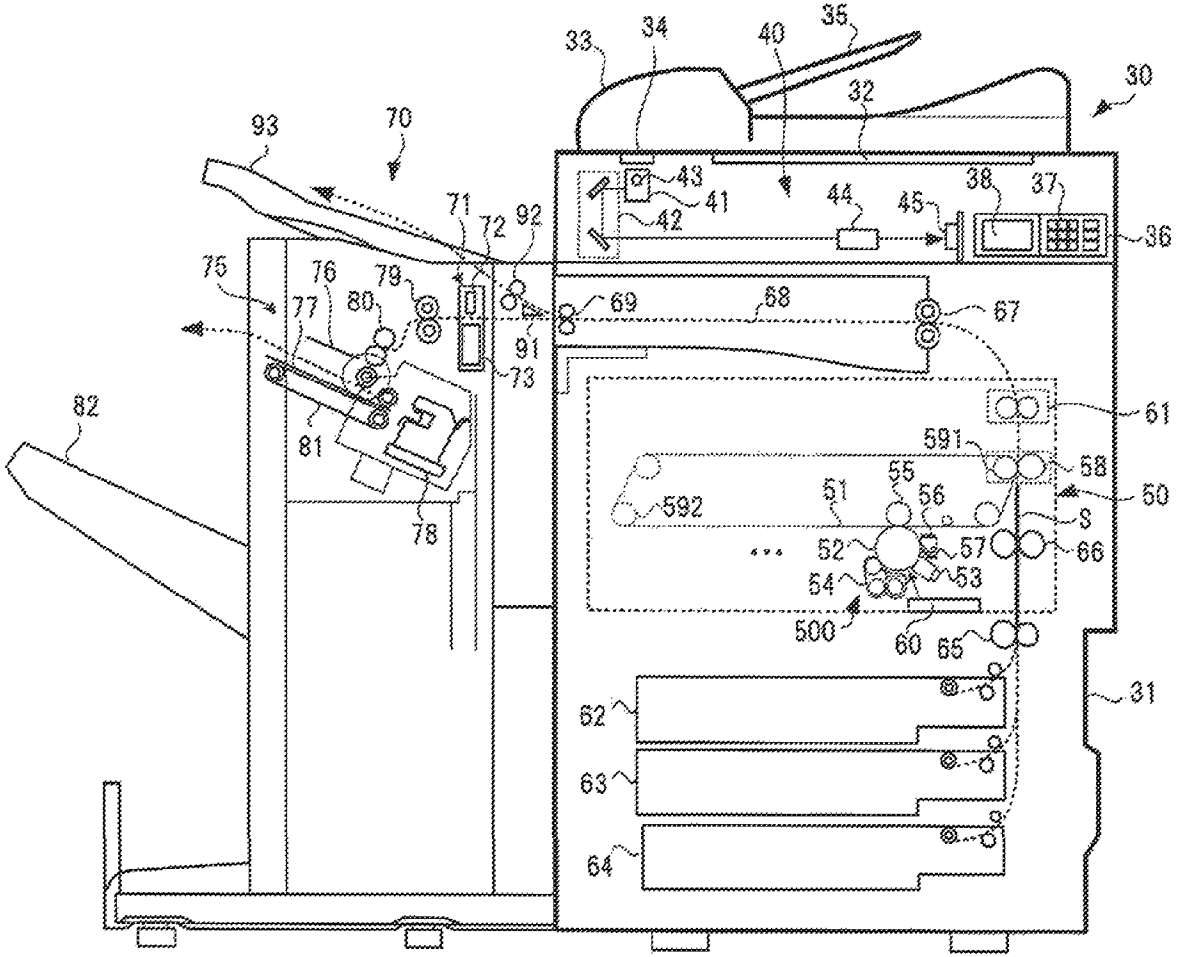
FIG. 12 illustrates a modified example configuration of the image forming apparatus and the finisher.

In FIG. 12, the gate 91 and the discharge roller 92 are disposed in front of the punching unit 71 in the finisher 70. Therefore, a sheet for which post-processing is not necessary may be discharged to the fixed tray 93 of the finisher 70, by switching the gate 91. When post-processing is to be performed, a sheet is transported to the finisher 70.

Figure 10:
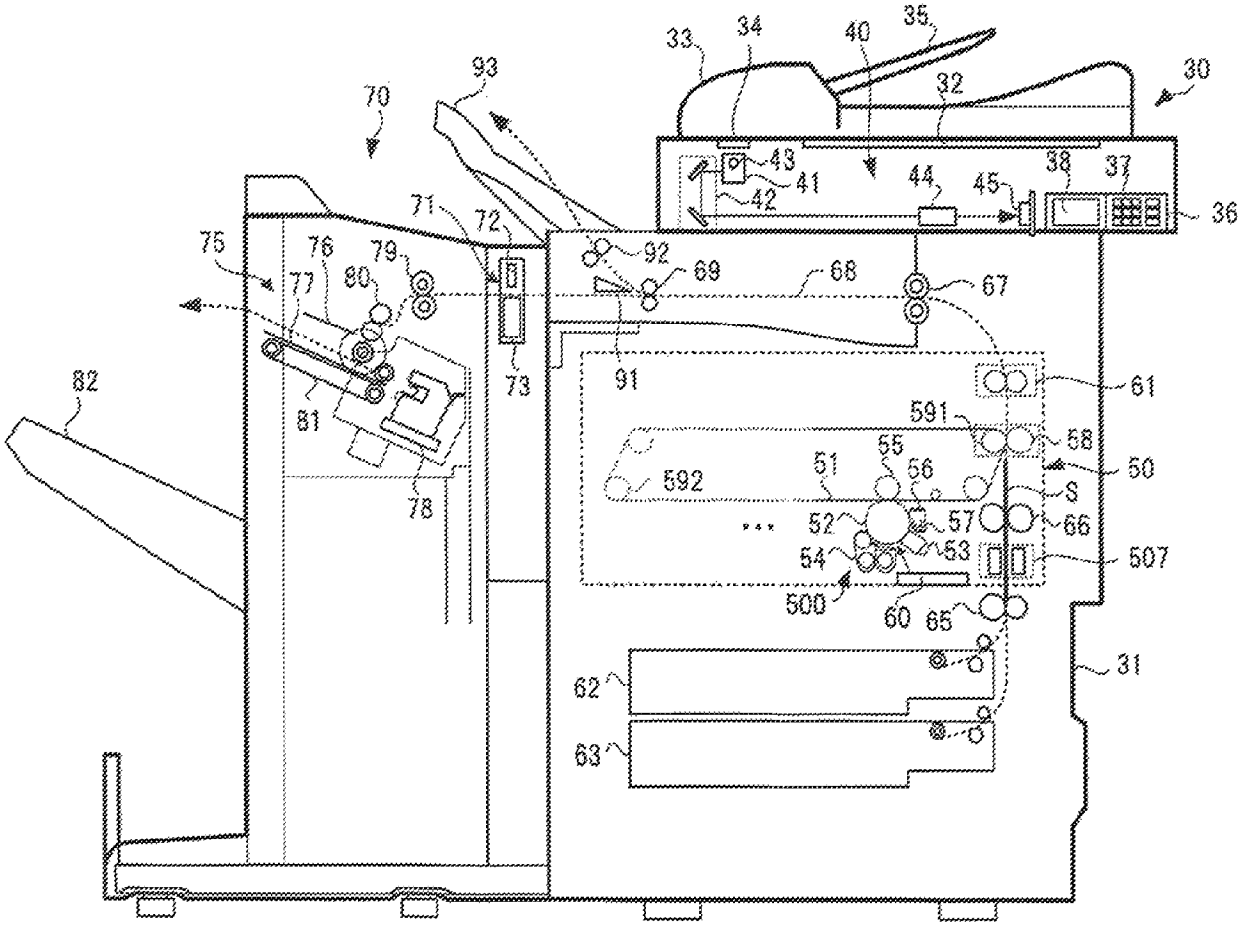
FIG. 10 illustrates an example configuration of an image forming apparatus and a finisher according to a second embodiment.

In FIG. 5, FIG. 10, and FIG. 12, the first carriage 41 may be replaced by a scan head that includes an LED element. Although each unit is described as being controlled by the main CPU 301 of the main control unit 300 and the printer CPU 501 of the printer unit 50 in FIG. 6, the main CPU 301 and the printer CPU 501 may be configured as a single CPU.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet erasing apparatus comprising:

an erasing unit configured to erase an image formed on a sheet with a decolorable colorant;

a scanning unit configured to generate image data from reading a surface of the sheet;

a first sheet cassette;

a second sheet cassette;

a third sheet cassette;

a sheet conveying unit configured to convey the sheet through the erasing unit and the scanning unit, and to any one of the first, second and third sheet cassettes; and a processing unit configured to determine a number of times an image formed with the decolorable colorant has been erased from the sheet, and determine whether the sheet is reusable based on the image data, wherein when the sheet is determined to be reusable and the number of times an image formed with the decolorable colorant has been erased from the sheet is less than a predetermined number, the sheet is conveyed to the first sheet cassette, when the sheet is determined to be reusable and the number of times an image formed with the decolorable colorant has been erased from the sheet is equal to a predetermined number, the sheet is conveyed to the second sheet cassette, and when the sheet is determined to not be reusable, the sheet is conveyed to the third sheet cassette.

2. The sheet erasing apparatus of claim 1, wherein the sheet is determined to not be reusable if, based on the image data, the processing unit determines that:

a residual image remains on the sheet, the sheet is deformed, the sheet is damaged, or the number of times an image formed with the decolorable colorant has been erased exceeds the predetermined number.

* * * * *